US008289354B2

(12) United States Patent
Morooka et al.

(10) Patent No.: US 8,289,354 B2
(45) Date of Patent: Oct. 16, 2012

(54) THERMAL HEAD AND PRINTER

(75) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 208 days.

(21) Appl. No.: 12/807,854

(22) Filed: Sep. 15, 2010

(65) Prior Publication Data

US 2011/0063396 A1 Mar. 17, 2011

(30) Foreign Application Priority Data

Sep. 16, 2009 (JP) ..... 2009-214818

(51) Int. Cl.
*B41J 2/335* (2006.01)

(52) U.S. Cl. ..... 347/202

(58) Field of Classification Search ..... 347/200, 347/202, 205
See application file for complete search history.

(56) References Cited

U.S. PATENT DOCUMENTS

| | | | | |
|---|---|---|---|---|
| 8,144,175 | B2 * | 3/2012 | Koroishi et al. | 347/200 |
| 2009/0102911 | A1 * | 4/2009 | Koroishi et al. | 347/206 |
| 2009/0102912 | A1 * | 4/2009 | Koroishi et al. | 347/206 |

FOREIGN PATENT DOCUMENTS

| | | |
|---|---|---|
| EP | 2059090 | 5/2009 |

* cited by examiner

*Primary Examiner* — Huan Tran
(74) *Attorney, Agent, or Firm* — Adams & Wilks

(57) ABSTRACT

Provided are a thermal head that has a cavity portion at a position corresponding to heating resistors and is capable of improving thermal efficiency while ensuring strength of the cavity portion, and a printer including the thermal head. The thermal head (1) includes: a supporting substrate (3) including a concave portion (2) in a surface thereof; an upper substrate (5) bonded in a stacked state to the surface of the supporting substrate (3); and a heating resistor (7) provided at a position, which corresponds to the concave portion (2), of a surface of the upper substrate (5), in which a centerline average roughness of at least a region of a back surface of the upper substrate (5) is set to be less than 5 nm, the region being opposed to the concave portion (2).

10 Claims, 9 Drawing Sheets

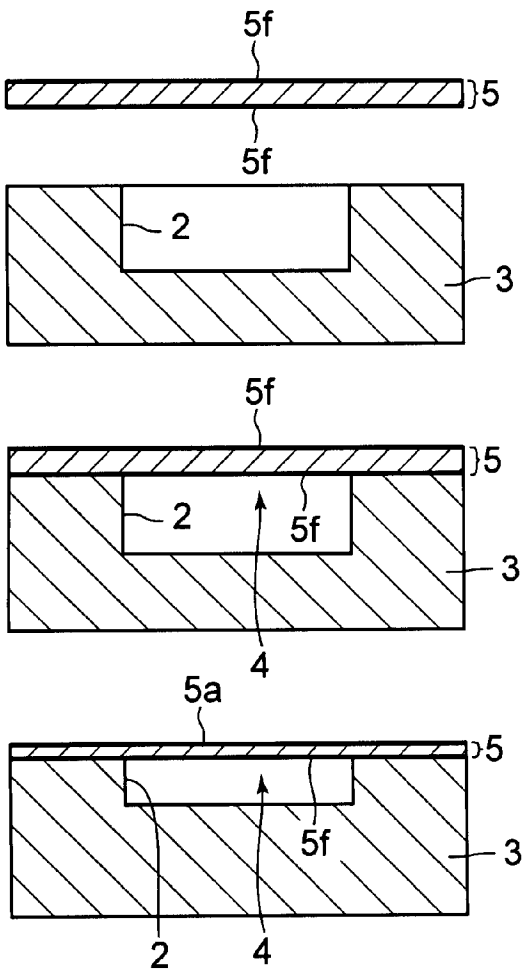
FIG. 5A
FIG. 5B
FIG. 5C
FIG. 5D
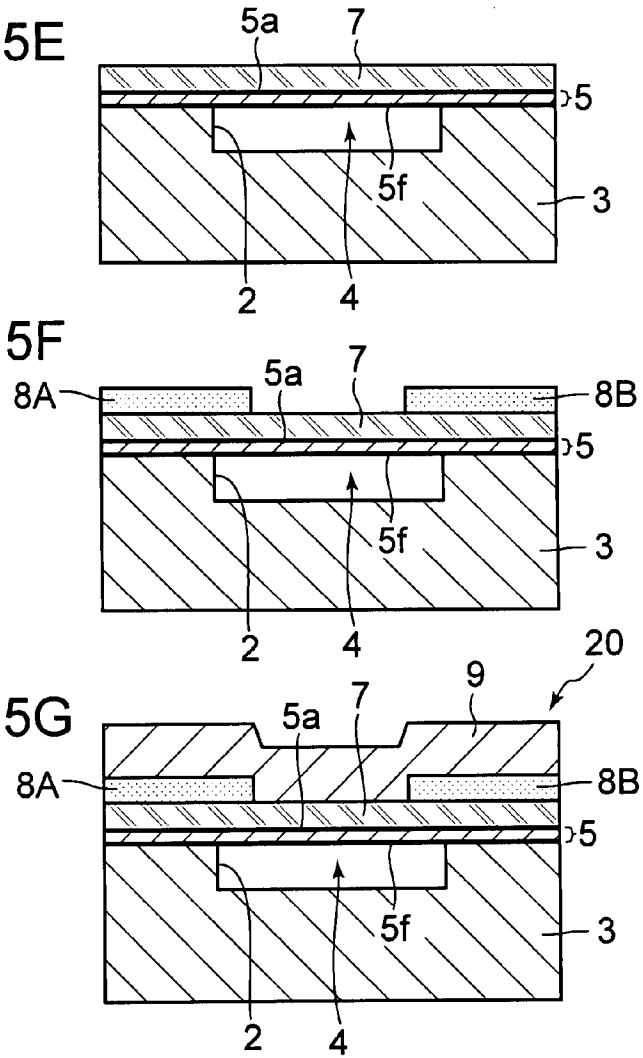
FIG. 5E
FIG. 5F
FIG. 5G

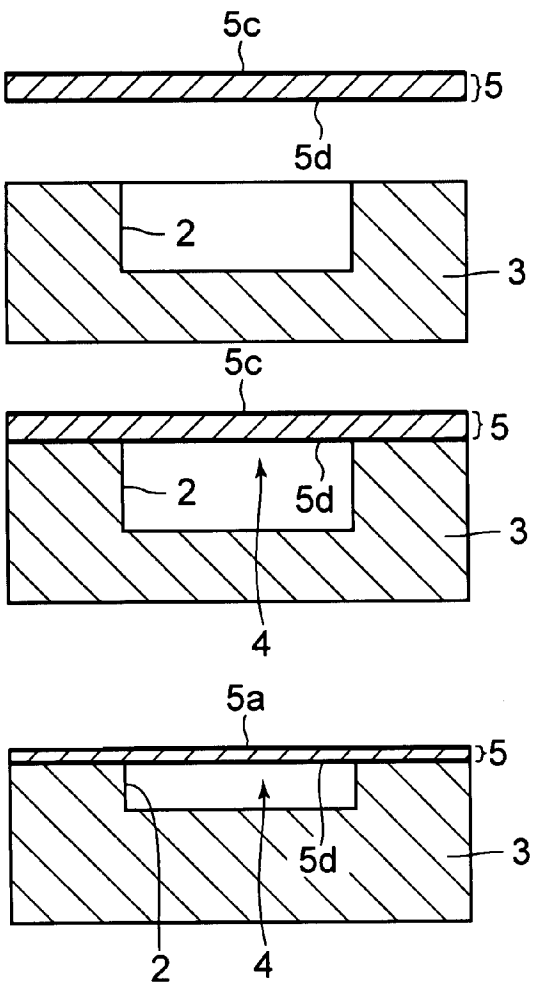
FIG. 8A PRIOR ART
FIG. 8B PRIOR ART
FIG. 8C PRIOR ART
FIG. 8D
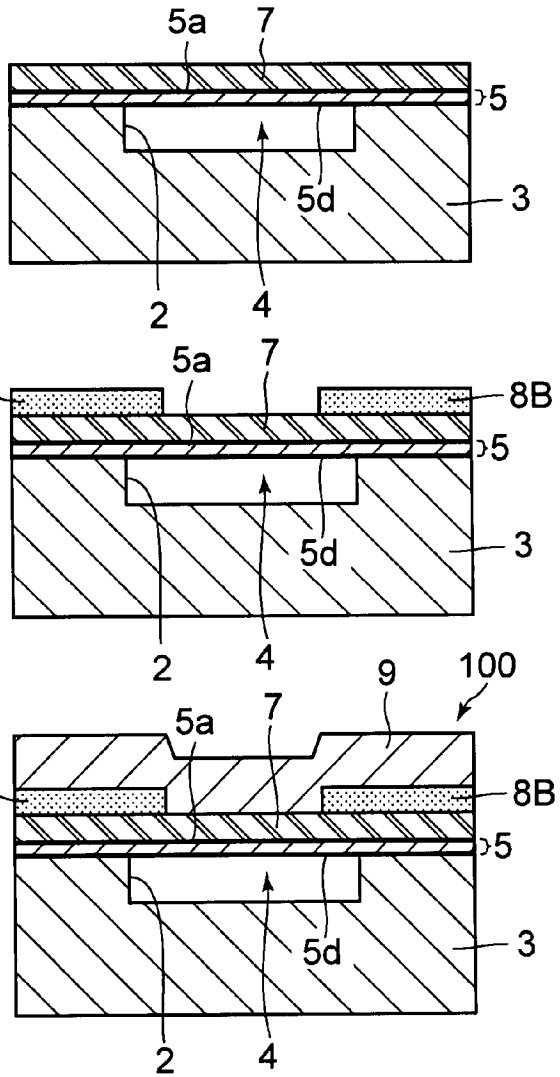
FIG. 8E PRIOR ART
FIG. 8F PRIOR ART
FIG. 8G PRIOR ART FIG. 9A PRIOR ART
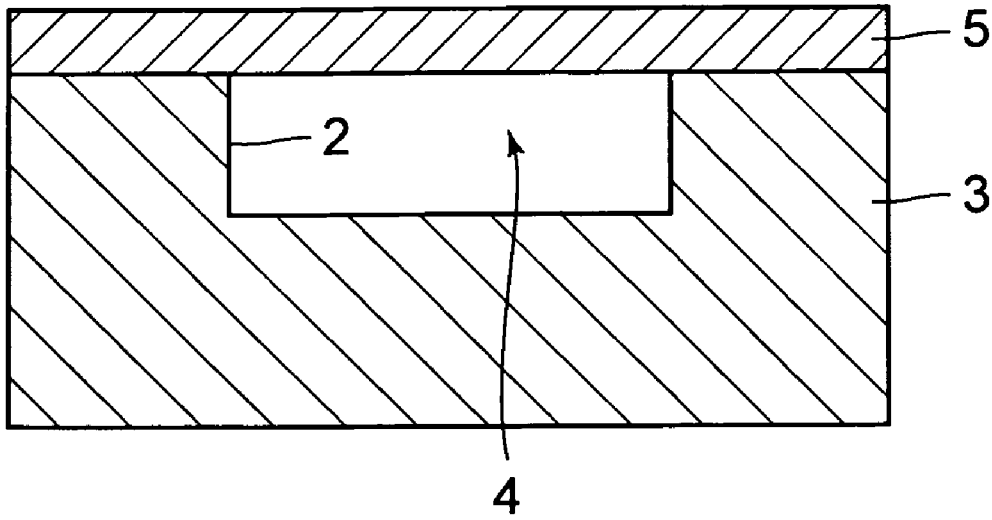
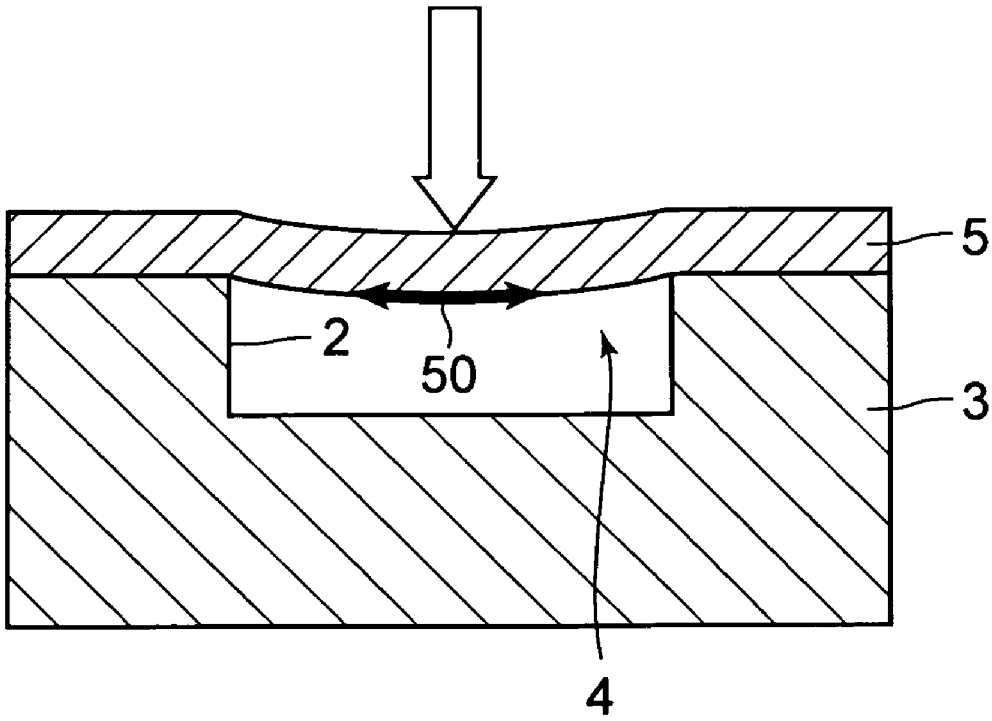
FIG. 9B PRIOR ART

THERMAL HEAD AND PRINTER

BACKGROUND OF THE INVENTION

1. Field of the Invention

The present invention relates to a thermal head and a printer including the same.

2. Description of the Related Art

There has been conventionally known a thermal head for use in thermal printers, which performs printing on a heat-sensitive recording medium such as paper by selectively driving some of a plurality of heating elements based on printing data (see, for example, Japanese Patent Application Laid-open No. 2007-83532).

In the thermal head disclosed in Japanese Patent Application Laid-open No. 2009-119850, a thin glass plate is bonded to a substrate in which a concave portion is formed, and heating resistors are provided on the thin glass plate, whereby a cavity portion is formed in a region of the substrate, which corresponds to the heating resistors. This thermal head allows the cavity portion to function as a heat-insulating layer having a low thermal conductivity, and reduces an amount of heat flowing from the heating resistors to the substrate, thereby improving thermal efficiency and reducing power consumption.

For example, as disclosed in Japanese Patent Application Laid-open No. Hei 06-298539, for bonding pieces of glass to each other, substrates subjected to mirror polishing are used in order to obtain smooth substrate surfaces. It is difficult to manufacture a thin glass plate having a thickness of 100 μm or less, and it is difficult to handle the thin glass plate in a manufacturing process of the thermal head. Therefore, a material glass plate having a thickness allowing relatively easy handling thereof is bonded to the substrate, and thereafter, is processed to a desired thickness by mechanical polishing or the like, whereby a thin glass plate having the thickness of 100 μm or less is realized.

Incidentally, in the mechanical polishing, in order to form a glass substrate, which is obtained by bonding the material glass plate and the substrate to each other, to a desired thickness, a two-stage-process polishing operation is performed, in which second-stage finish polishing is performed after first-stage rough polishing. In this case, the finish polishing or the like is performed for a surface of the substrate, the surface roughness of which is increased by the first-stage rough polishing, and the surface of the glass substrate is finished into mirror surface.

However, the glass substrate the thickness of which is reduced by the first-stage rough polishing are decreased in strength, and accordingly, an apprehension that the glass substrate may be broken at the time of the subsequent finish polishing is increased. Further, in the finish polishing, polish grain is fine, and accordingly, it is necessary to increase load applied to the substrate as compared with the case of the rough polishing. Therefore, at the time of the finish polishing, a large tensile stress occurs in a portion of the thin glass plate, which faces to the cavity portion. In particular, many cracks are included in a surface of the thin glass plate processed by the mechanical polishing or the like, there is a problem in that the thin glass plate is prone to break when the cracks grow.

Further, a printer that mounts the above-mentioned thermal head thereon has a structure in which thermal paper is pressed against a platen roller in a sandwiched manner. Hence, the heating resistors of the thermal head are pressed against the thermal paper with predetermined pressing force by a pressure mechanism. In particular, in the case where minute foreign matters each having a size ranging from several micrometers to several ten micrometers are interposed between the platen roller and heater portions, an extremely large tensile stress occurs in the portion of the thin glass plate, which faces to the cavity portion. Thus, the thin glass plate is prone to be broken.

Meanwhile, in order to prevent such a breakage of the thin glass plate, it is necessary to ensure the strength of the thin glass plate. However, in accordance with the conventional thermal head, the thin glass plate must be thickened in order to ensure the strength of the thin glass plate, and accordingly, there is a disadvantage of decreasing thermal efficiency of the thermal head because an amount of heat transfer from the heating resistors is increased.

The present invention has been made in view of the above-mentioned circumstances. It is an object of the present invention to provide a thermal head that has a cavity portion at a position corresponding to heating resistors and is capable of improving thermal efficiency while ensuring strength of the cavity portion, and a printer including the thermal head.

SUMMARY OF THE INVENTION

In order to achieve the object described above, the present invention provides the following means.

In order to achieve the above-mentioned object, according to a first aspect of the present invention, there is provided a thermal head, including: a supporting substrate including a concave portion in a surface thereof; an upper substrate bonded in a stacked state to the surface of the supporting substrate; and a heating resistor provided at a position, which corresponds to the concave portion, of a surface of the upper substrate, in which a centerline average roughness of at least a region of a back surface of the upper substrate is set to be less than 5 nm, the region being opposed to the concave portion.

The upper substrate on which the heating resistor is provided functions as a heat storage layer that stores heat generated from the heating resistor. Further, the concave portion formed in the surface of the supporting substrate forms a cavity portion between the supporting substrate and the upper substrate in such a manner that the supporting substrate and the upper substrate are bonded in the stacked state to each other. This cavity portion is formed in the region corresponding to the heating resistor, and functions as a heat-insulating layer that shields heat generated from the heating resistor. Hence, in accordance with the present invention, the heat generated from the heating resistor can be suppressed from being transferred through the upper substrate to the supporting substrate and dissipated therein, and a usage rate of the heat generated from the heating resistor, that is, the thermal efficiency of the thermal head can be improved.

Here, in the case where load is applied to the upper substrate, the region of the upper substrate, which corresponds to the concave portion, is deformed, and in the above-mentioned region, the tensile stress occurs in the back surface of the upper substrate. In this case, in the present invention, the centerline average roughness of at least the region of the back surface of the upper substrate, which is opposed to the concave portion, is set to be less than 5 nm. Thus, growth of the cracks in the back surface of the upper substrate, which is caused by stress concentration to the cracks, can be prevented. That is, in accordance with the present invention, the strength of the upper substrate is enhanced, whereby the upper substrate can be thinned. Accordingly, the thermal efficiency of the thermal head can be improved, and an amount of energy required for the printing can be reduced.

In the first aspect, an average depth of a mark formed in at least the region of the back surface of the upper substrate may be set to be less than 0.1 μm, the region being opposed to the concave portion.

As the cracks become deeper, the stress occurring at tip ends of the cracks become larger. Then, the cracks grow. Accordingly, in at least the region of the back surface of the upper substrate, which is opposed to the concave portion, that is, in a region to which the tensile stress is applied, an average depth of cut marks owing to the mechanical polishing or the like is set to be less than 0.1 μm, whereby the growth of the cracks can be suppressed.

In the first aspect, wet etching by HF solution may be performed to at least the region of the back surface of the upper substrate, the region being opposed to the concave portion.

At least the region of the back surface of the upper substrate, which is opposed to the concave portion, is subjected to the wet etching by HF solution or HF mixed solution, whereby the cut marks formed in the polishing step can be made small, and the depth of the cracks can be decreased. Thus, the growth of the cracks in the back surface of the upper substrate can be suppressed, and the strength of the upper substrate can be enhanced.

Further, instead of the wet etching, a surface layer in at least the region of the back surface of the upper substrate may be removed by anisotropic etching by a predetermined amount, the region being opposed to the concave portion. With this, almost all of the cut marks formed in the polishing step can be removed. Almost all of latent flaws can be removed.

As an example of the anisotropic etching, there is dry etching including: various types of ion beam etchings as well as reactive ion beam etching; plasma etching; sputter etching; optical etching; a gas cluster ion beam method; and the like.

In the first aspect, at least the region of the back surface of the upper substrate may be removed by wet etching by 5 μm or more, the region being opposed to the concave portion.

At least the region of the back surface of the upper substrate, which is opposed to the concave portion, is removed by 5 μm or more by the wet etching, microcracks in the back surface of the upper substrate can be removed, and the strength of the upper substrate can be enhanced.

In the first aspect, the upper substrate may be a raw glass plate manufactured by one of a fusion method and a down draw method, and the back surface of the upper substrate bonded to the surface of the supporting substrate may be a fire finished surface remained unprocessed after the upper substrate is manufactured.

In accordance with the fusion method or the down draw method, glass having a sufficiently small surface roughness in an unpolished state can be manufactured. Hence, the glass manufactured by such a manufacturing method is used as the upper substrate, whereby sufficient strength can be ensured even if the fire finished surface remained unprocessed after the upper substrate is manufactured is used as a bonding surface to the supporting substrate, and a necessity to perform flattening treatment to the back surface of the upper substrate by the wet etching, the mechanical polishing, or the like can be eliminated.

In the first aspect, mechanical polishing may be performed to the surface of the upper substrate to enhance parallelism of the upper substrate.

The glass manufactured by the fusion method, the down draw method, or the like is used as the upper substrate, and the mechanical polishing is performed to the surface of the upper substrate, whereby an upper substrate having high parallelism can be formed. Thus, an upper substrate having small thickness variations can be formed, and accordingly, thermal efficiency of all the thermal heads arranged on the entire substrate can be uniformed, and yield of the thermal heads can be enhanced.

In the first aspect, the supporting substrate and the upper substrate may be bonded to each other in a dry state, and the substrates bonded to each other may be subjected to heat treatment at 200° C. or higher and softening points of the substrates or lower.

Owing to the heat treatment for the cracks, dangling bonds of Si on the surfaces of the cracks are sometimes recombined with one another to return to restore an original crack-free state. This phenomenon is referred to as a crack healing effect. With regard to the crack healing effect, OH groups are terminated on the surfaces of the cracks in a state where moisture is high. In the case of performing the heat treatment in this state, the moisture is entrapped in the cavity portion, the dangling bonds of Si on the surfaces of the cracks remain combined with the OH groups, and it becomes difficult to restore the original crack-free state.

Hence, the supporting substrate and the upper substrate are bonded to each other in the dry state, and thereafter, the substrates thus bonded to each other are dried and then subjected to the heat treatment. In this manner, owing to the crack healing effect, even if the heat treatment is performed at a relatively low temperature, the cracks in the region of the upper substrate, which is opposed to the cavity portion, can be reduced, a depth thereof can also be decreased, and the strength of the upper substrate can be enhanced. Specifically, the heat treatment is performed at 200° C. or higher, whereby the OH groups remaining on the surfaces of the cracks are removed, and the recombination of the dangling bonds of Si can be strengthened. Further, the heat treatment is performed at the softening point or lower, whereby the deformation of the upper substrate can be suppressed, and the strength of the upper substrate can be enhanced without deteriorating flatness thereof.

According to the second aspect according of the present invention, there is provided a printer including the above-mentioned thermal head.

In accordance with the printer as described above, the above-mentioned thermal head is provided, and accordingly, the thermal efficiency of the thermal head can be improved in such a manner that the upper substrate is thinned while ensuring the strength of the upper substrate, and the amount of energy required for the printing can be reduced. Thus, the printing can be performed for the thermal paper with less electric power, a battery duration can be increased, and in addition, reliability of the entire printer can be enhanced.

According to present invention, the thermal head that has the cavity portion at the position corresponding to the heating resistors exerts an effect of improving the thermal efficiency while ensuring the strength of the cavity portion.

BRIEF DESCRIPTION OF THE DRAWINGS

In the accompanying drawings:

FIG. 4A illustrates a pretreatment step; FIG. 4B illustrates a cavity portion forming step; FIG. 4C illustrates a smoothing step; FIG. 4D illustrates a bonding step; FIG. 4E illustrates a plate thinning step; FIG. 4F illustrates a resistor forming step; FIG. 4G illustrates an electrode forming step; and FIG. 4H illustrates a protective film forming step;

FIGS. 5A to 5G are views for describing a manufacturing method for a thermal head according to a second embodiment of the present invention: FIG. 5A illustrates a smooth substrate manufacturing step; FIG. 5B illustrates a cavity portion forming step; FIG. 5C illustrates a bonding step; FIG. 5D illustrates a plate thinning step; FIG. 5E illustrates a resistor forming step; FIG. 5F illustrates an electrode forming step; and FIG. 5G illustrates a protective film forming step;

FIG. 6A illustrates a smooth substrate manufacturing step; FIG. 6B illustrates a parallelization processing step; FIG. 6C illustrates a cavity portion forming step; FIG. 6D illustrates a bonding step; FIG. 6E illustrates a plate thinning step; FIG. 6F illustrates a resistor forming step; FIG. 6G illustrates an electrode forming step; and FIG. 6H illustrates a protective film forming step;

FIGS. 8A to 8G are views for describing a manufacturing method for the thermal head of FIG. 7: FIG. 8A illustrates a pretreatment step; FIG. 8B illustrates a cavity portion forming step; FIG. 8C illustrates a bonding step; FIG. 8D illustrates a plate thinning step; FIG. 8E illustrates a resistor forming step; FIG. 8F illustrates an electrode forming step; FIG. 8G illustrates a protective film forming step; and FIGS. 9A and 9B are views for describing a behavior of the thermal head in a case where load is applied thereto: FIG. 9A illustrates a state of the thermal head when no load is applied thereto; and FIG. 9B illustrates a state of the thermal head when load is applied thereto.

DETAILED DESCRIPTION OF THE PREFERRED EMBODIMENTS

First Embodiment

A thermal head 1 and a thermal printer 10 according to a first embodiment of the present invention are described below with reference to the drawings.

Figure 1:
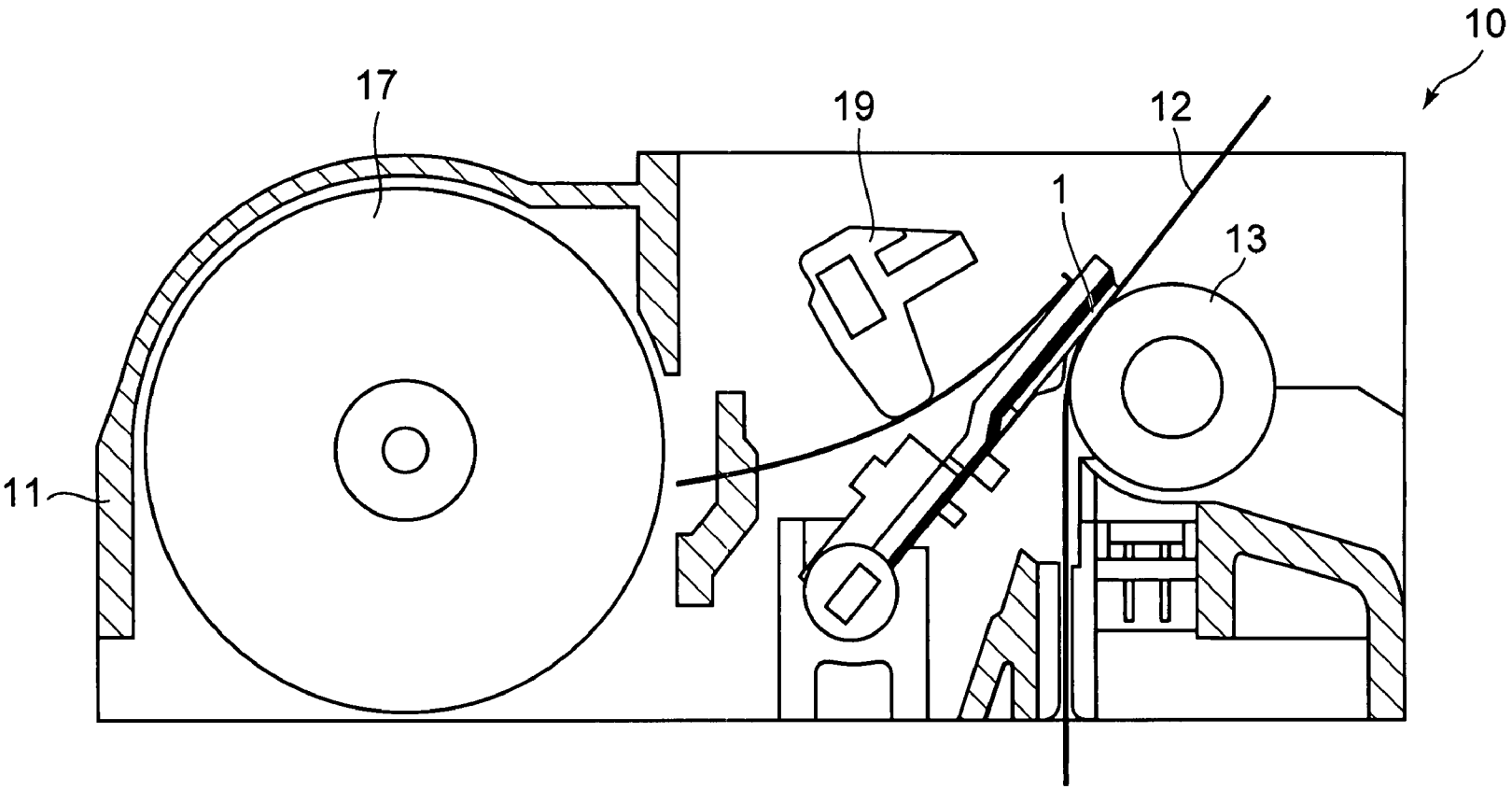
FIG. 1 is a schematic configuration diagram of a thermal printer according to a first embodiment of the present invention.

The thermal head 1 according to this embodiment is used for the thermal printer 10, for example, as illustrated in FIG. 1, and performs printing in an object to be printed such as thermal paper 12 by selectively driving a plurality of heater elements based on printing data.

The thermal printer 10 includes: a main body frame 11; a platen roller 13 arranged horizontally; the thermal head 1 arranged oppositely to an outer peripheral surface of the platen roller 13; a heat dissipation plate (not shown) supporting the thermal head 1; a paper feeding mechanism 17 for feeding the thermal paper 12 between the platen roller 13 and the thermal head 1; and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. With this, load of the platen roller 13 is applied to the thermal head 1 through an intermediation of the thermal paper 12.

The heat dissipation plate is a plate-shaped member made of metal such as aluminum, a resin, ceramics, glass, or the like, and serves for fixation and heat dissipation of the thermal head 1.

Figure 2:
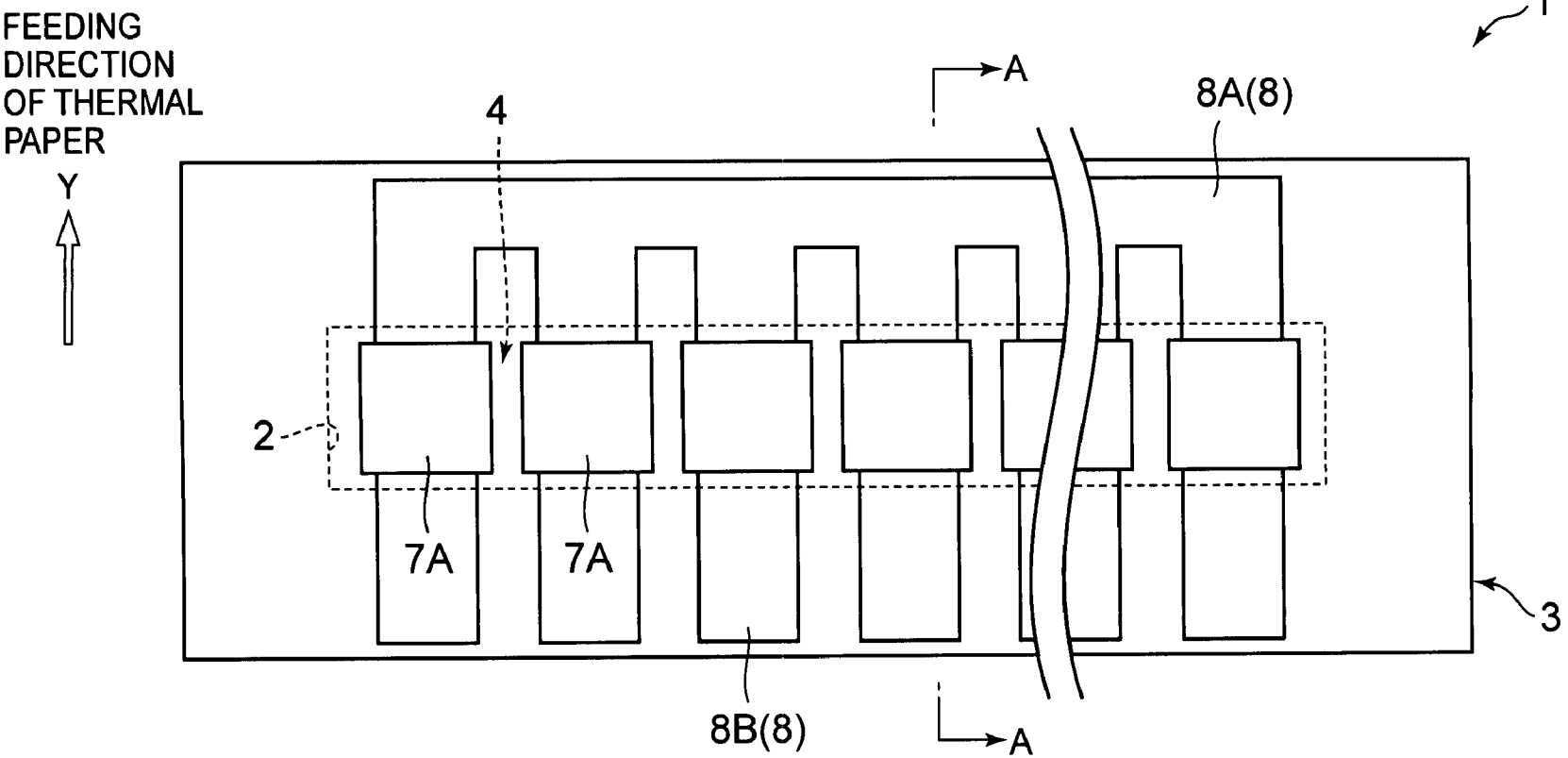
FIG. 2 is a plan view of the thermal head of FIG. 1 when viewed from a protective film side.

As illustrated in FIG. 2, in the thermal head 1, a plurality of heating resistors 7 and a plurality of electrode portions 8 are arrayed in a longitudinal direction of a supporting substrate 3. The arrow Y denotes a feeding direction of the thermal paper 12 by the paper feeding mechanism 17. Further, on a surface of the supporting substrate 3, there is formed a rectangular concave portion 2 extending in the longitudinal direction of the supporting substrate 3.

Figure 3:
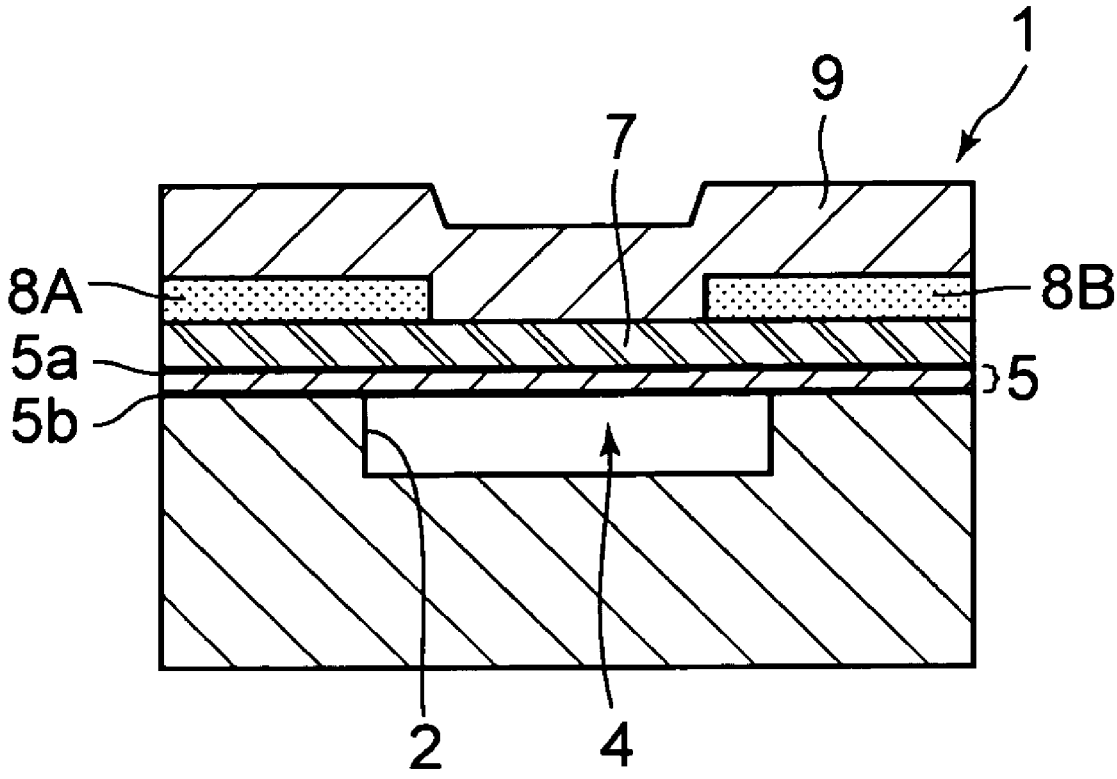
FIG. 3 is a sectional view (cross-sectional view) of the thermal head of FIG. 2, which is taken along the arrow A-A.

A sectional view taken along the arrow A-A of FIG. 2 is illustrated in FIG. 3.

As illustrated in FIG. 3, the thermal head 1 includes: the rectangular supporting substrate 3; an upper substrate 5 bonded to the surface of the supporting substrate 3; the plurality of heating resistors 7 provided on the upper substrate 5; the electrode portions 8 connected to the heating resistor 7; and a protective film 9 that covers the heating resistors 7 and the electrode portions 8, and protects the heating resistors 7 and the electrode portions 8 from abrasion and corrosion.

For example, the supporting substrate 3 is an insulating substrate such as a glass substrate or a silicon substrate, which has a thickness approximately ranging from 300 μm to 1 mm. In an upper end surface (surface) of the supporting substrate 3, that is, in an interface between the supporting substrate 3 and the upper substrate 5, the rectangular concave portion 2 extending in the longitudinal direction of the supporting substrate 3 is formed. For example, this concave portion 2 is a groove with a depth approximately ranging from 1 μm to 100 μm and a width approximately ranging from 50 μm to 300 μm.

For example, the upper substrate 5 is formed of a glass material with a thickness approximately ranging from 10 μm to 100 μm±5 μm, and functions as a heat storage layer that stores heat generated from the heating resistors 7. This upper substrate 5 is bonded in a stacked state to the surface of the supporting substrate 3 so as to hermetically seal the concave portion 2. The concave portion 2 is covered with the upper substrate 5, whereby a cavity portion 4 is formed between the upper substrate 5 and the supporting substrate 3.

Further, as described later, the upper substrate 5 includes an upper end surface (surface) on which the heating resistors 7 are provided, and on a lower end surface (back surface) bonded to the supporting substrate 3. On the upper end surface, there is formed a second polished surface 5*a* subjected to mechanical polishing. On the lower end surface, there is formed a smooth surface 5*b* subjected to wet etching by HF solution. The smooth surface 5*b* of the upper substrate 5 has a centerline average roughness Ra set to be less than 5 nm.

The cavity portion 4 has a communication structure opposed to all of the heating resistors 7. The cavity portion 4 functions as a hollow heat-insulating layer that suppresses the heat, which is generated from the heating resistors 7, from transferring from the upper substrate 5 to the supporting substrate 3. In this manner, an amount of heat, which transfers to the above of the heating resistors 7 and is used for printing and the like, can be increased more than an amount of heat, which transfers to the supporting substrate 3 through the upper substrate 5 located below the heating resistors 7. Hence, thermal efficiency of the thermal head 1 can be improved.

The heating resistors 7 are each provided so as to straddle the concave portion 2 in its width direction on an upper end surface of the upper substrate 5, and are arranged at predetermined intervals in the longitudinal direction of the concave portion 2. In other words, each of the heating resistors 7 is provided to be opposed to the hollow portion 4 through an intermediation of the heat storage layer 5 so as to be situated above the hollow portion 4.

The electrode portions 8 serve to heat the heating resistors 7, and are constituted by a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7, and the individual electrodes 8B are connected to the heating resistors 7, respectively.

When voltage is selectively applied to the individual electrodes 8B, current flows through the heating resistors 7 connected to the selected individual electrodes 8B and the common electrode 8A opposed thereto, whereby the heating resistors 7 are heated. In this state, the thermal paper 12 is pressed by the operation of the pressure mechanism 19 against the surface portion (printing portion) of the protective film 9 covering the heating portions of the heating resistors 7, whereby color is developed on the thermal paper 12 and printing is performed.

Note that, of each of the heating resistors 7, an actually heating portion (hereinafter, referred to as "heating portion 7A in FIG. 2") is a portion of each of the heating resistors 7 on which the electrode portions 8A, 8B do not overlap, that is, a portion of each of the heating resistors 7 which is a region between the connecting surface of the common electrode 8A and the connecting surface of each of the individual electrodes 8B and is situated substantially directly above the hollow portion 4.

Hereinafter, a manufacturing method for the thermal head 1 constructed as described above is described with reference to FIGS. 4A to 4H.

As illustrated in FIGS. 4A to 4H, the manufacturing method for the thermal head 1 according to this embodiment includes: a pretreatment step of mechanically polishing the upper substrate 5 before being subjected to a plate thinning process; a cavity portion forming step of forming the concave portion 2 in the supporting substrate 3; a smoothing step of performing smoothing treatment on the upper substrate 5; a bonding step of bonding the surface of the supporting substrate 3 and the back surface of the upper substrate 5 to each other; a plate thinning step of thinning the upper substrate 5 bonded to the supporting substrate 3; a resistor forming step of forming the heating resistors 7 on the surface of the upper substrate 5; an electrode forming step of forming the electrode portions 8 on the heating resistors 7; and a protective film forming step of forming the protective film 9 on the electrode portions 8. The above-mentioned respective steps are specifically described below.

Figures 4A, 4B, 4C, 4D, 4E:
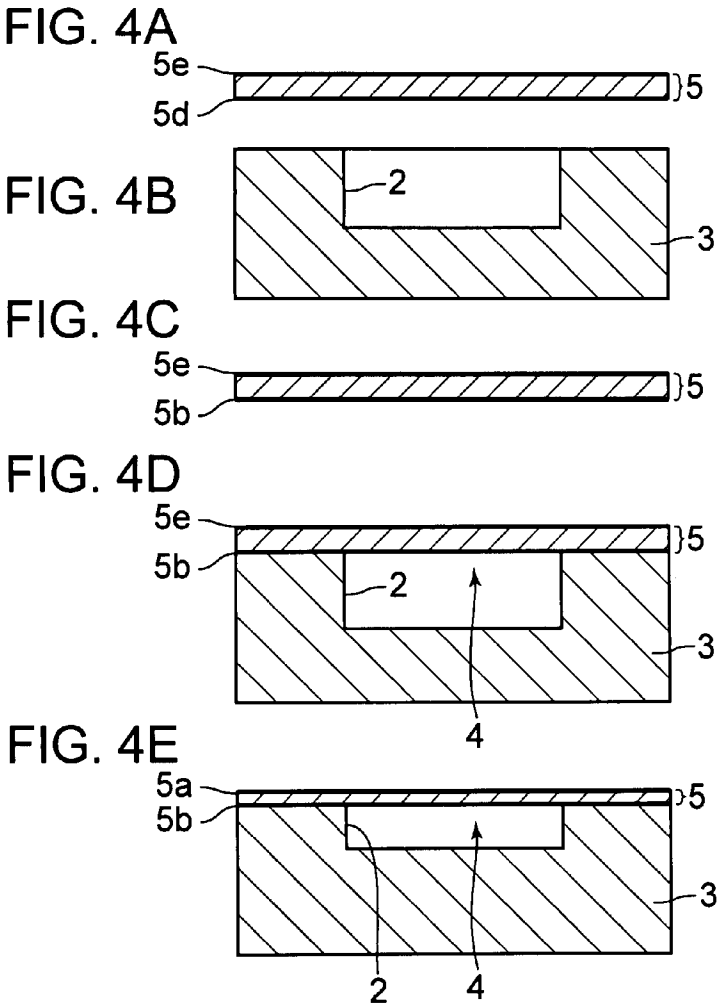
FIGS. 4A to 4H are views for describing a manufacturing method for the thermal head of FIG. 3.

In the pretreatment step, as illustrated in FIG. 4A, the mechanical polishing is performed on the upper substrate 5 before being subjected to the plate thinning process, whereby polished surfaces 5*c* and 5*d* are formed on the upper end surface (surface) and lower end surface (back surface) of the upper substrate 5, respectively.

Next, in the cavity portion forming step, as illustrated in FIG. 4B, in the upper end surface (surface) of the supporting substrate 3, the concave portion 2 is formed at a position corresponding to a region in which the heating resistors 7 of the upper substrate 5 are provided. The concave portion 2 is formed by performing, for example, sandblasting, dry etching, wet etching, or laser machining on the surface of the supporting substrate 3.

When the sandblasting is performed on the supporting substrate 3, the surface of the supporting substrate 3 is covered with a photoresist material, and the photoresist material is exposed to light using a photomask of a predetermined pattern, whereby there is cured a portion other than the region in which the concave portion 2 is formed.

After that, by cleaning the surface of the supporting substrate 3 and removing the photoresist material which is not cured, etching masks (not shown) having etching windows formed in the region in which the concave portion 2 is formed can be obtained. In this state, the sandblasting is performed on the surface of the supporting substrate 3, and the concave portion 2 having a depth ranging from 1 to 100 μm is formed. It is desirable that the depth of the concave portion 2 be, for example, 10 μm or more and half or less of the thickness of the supporting substrate 3.

Further, when etching, such as the dry etching and the wet etching, is performed, as in the case of the sandblasting, the etching masks having the etching windows formed in the region in which the concave portion 2 is formed are formed on the surface of the supporting substrate 3. In this state, by performing the etching on the surface of the supporting substrate 3, the concave portion 2 having the depth ranging from 1 to 100 μm is formed.

As such an etching process, there are used, for example, the wet etching using hydrofluoric acid-based etchant or the like, and the dry etching such as reactive ion etching (RIE) and plasma etching. Note that, as a reference example, in the case of a single-crystal silicon supporting substrate, there is performed the wet etching using the etchant such as tetramethylammonium hydroxide solution, KOH solution, and mixing solution of hydrofluoric acid and nitric acid.

Next, in the smoothing step, as illustrated in FIG. 4C, for example, the mechanically polished upper substrate 5 is subjected to treatment such as the wet etching by the HF solution, whereby smooth surfaces 5*e* and 5*b* are formed on the upper end surface (surface) and the lower end surface (back surface) of the upper substrate 5, respectively.

Next, in the bonding step, as illustrated in FIG. 4D, the lower end surface (back surface) of the upper substrate 5, for example, as a glass substrate having a thickness approximately ranging from 500 μm to 700 μm and the upper end surface (surface) of the supporting substrate 3 in which the concave portion 2 is formed are bonded to each other by high temperature fusing or anode bonding. At this time, the supporting substrate 3 and the upper substrate 5 are bonded to each other in a dry state, and the substrates thus bonded to each other are subjected to heat treatment at a temperature equal to or higher than 200° C. and equal to or lower than softening points thereof.

The supporting substrate 3 and the upper substrate 5 are bonded to each other, whereby the concave portion 2 formed in the supporting substrate 3 is covered with the upper substrate 5, and the cavity portion 4 is formed between the supporting substrate 3 and the upper substrate 5.

Here, it is difficult to manufacture and handle an upper substrate having a thickness of 100 μm or less, and such a substrate is expensive. Thus, instead of directly bonding an originally thin upper substrate 5 onto the supporting substrate 3, the upper substrate 5 having the thickness allowing easy manufacture and handling thereof in the bonding step is bonded onto the supporting substrate 3, and then, the upper substrate 5 is processed in the plate thinning step so that the upper substrate 5 has a desired thickness.

Next, in the plate thinning step, as illustrated in FIG. 4E, to the upper end surface (surface) side of the upper substrate 5, the plate thinning process is performed by the mechanical polishing, whereby the second polished surface 5*a* is formed on the upper end surface (surface) of the upper substrate 5.

Note that the plate thinning process may be performed by the dry etching, the wet etching, or the like.

Next, for each thermal head 1 divided as described above, the heating resistors 7, the common electrode 8A, the individual electrodes 8B, and the protective film 9 are sequentially formed on the upper substrate 5.

Figures 4F, 4G, 4H:
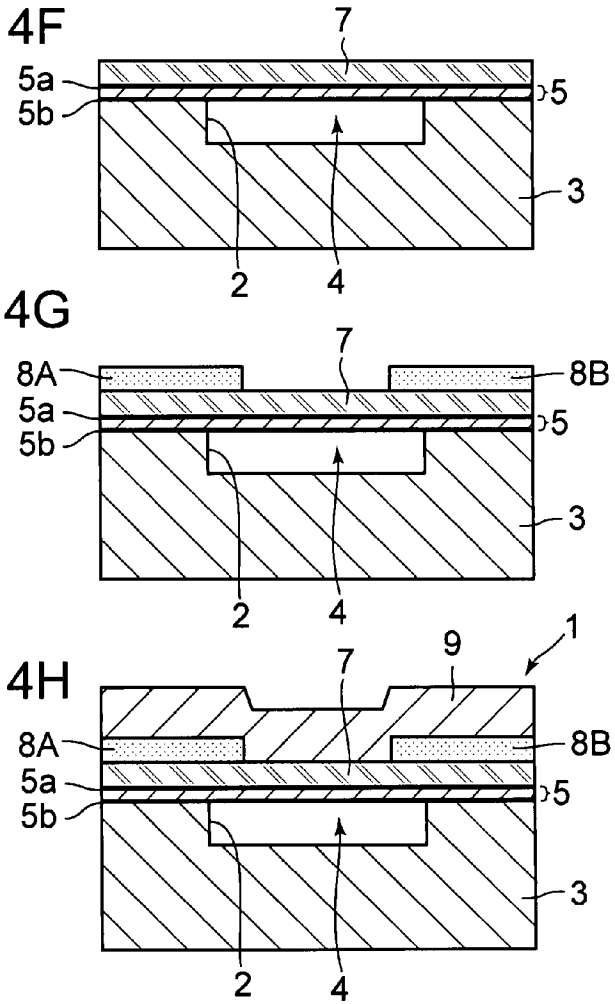
Figures 6A, 6B, 6C, 6D, 6E:
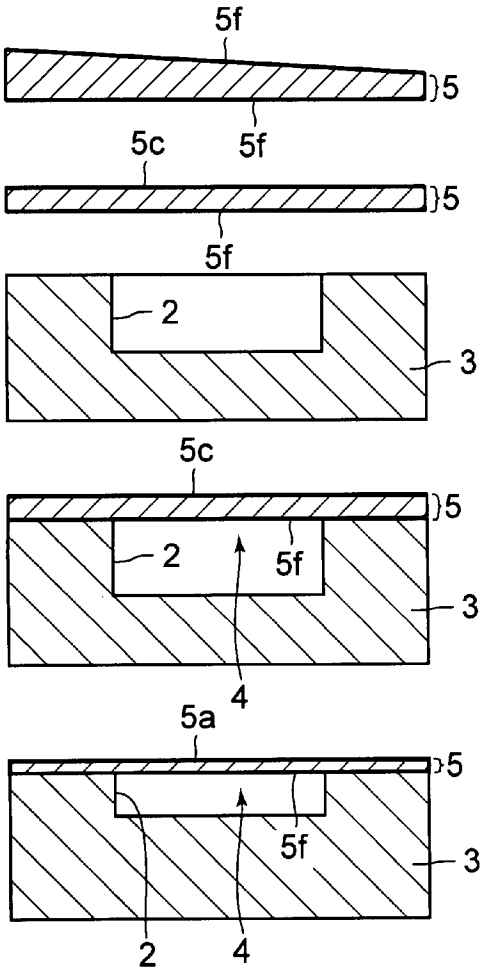
FIGS. 6A to 6H are views for describing a manufacturing method for a thermal head according to a third embodiment of the present invention.
Figures 6F, 6G, 6H:
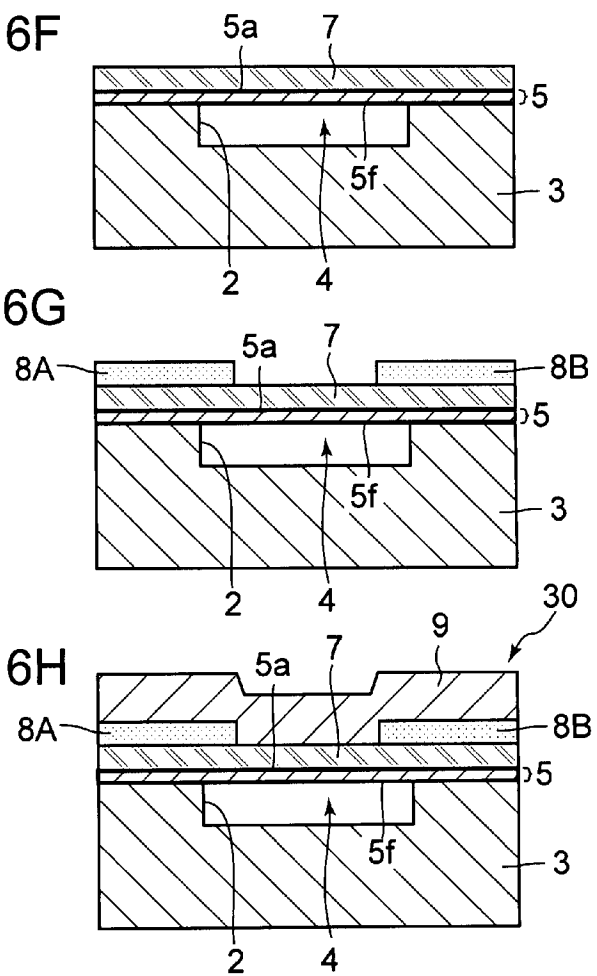

Specifically, in the resistor forming step, as illustrated in FIG. 4F, a thin film is formed from a heating resistor material such as a Ta-based material or a silicide-based material on the upper substrate 5 by a thin film forming method such as sputtering, chemical vapor deposition (CVD), or vapor deposition. The thin film of the heating resistor material is molded by lift-off, etching, or the like to form the heating resistors 7 having a desired shape.

Next, in the electrode forming step, as illustrated in FIG. 4G, the film formation with use of a wiring material such as Al, Al—Si, Au, Ag, Cu, and Pt is performed on the upper substrate 5 by using sputtering, vapor deposition, or the like. Then, the film thus obtained is formed by lift-off or etching, or the wiring material is screen-printed and is, for example, burned thereafter, to thereby form the common electrode 8A and the individual electrodes 8B which have the desired shape.

In the patterning of a resist material for the lift-off or etching for the heating resistors 7 and the electrode portions 8A, 8B, the patterning is performed on the photoresist material by using a photomask.

Next, in the protective film forming step, as illustrated in FIG. 4H, the film formation with use of a protective film material such as $SiO_2$, $Ta_2O_5$, SiAlON, $Si_3N_4$, or diamond-like carbon is performed on the upper substrate 5 by sputtering, ion plating, CVD, or the like, whereby the protective film 9 is formed. Thus, the thermal head 1 illustrated in FIG. 3 is manufactured.

Here, as a comparative example, a configuration of a conventional thermal head 100 and a manufacturing method therefor are described below.

As illustrated in FIG. 8A to FIG. 8G, the manufacturing method for the conventional thermal head 100 includes: a pretreatment step of mechanically polishing the upper substrate 5 before being subjected to a plate thinning process; a cavity portion forming step of forming the concave portion 2 in the supporting substrate 3; a bonding step of bonding the supporting substrate 3 and the upper substrate 5 to each other; a plate thinning step of thinning the upper substrate 5 bonded to the supporting substrate 3; a resistor forming step of forming the heating resistors 7 on the surface of the upper substrate 5; an electrode forming step of forming the electrode portions 8 on the heating resistors 7; and a protective film forming step of forming the protective film 9 on the electrode portions 8.

Figure 7:
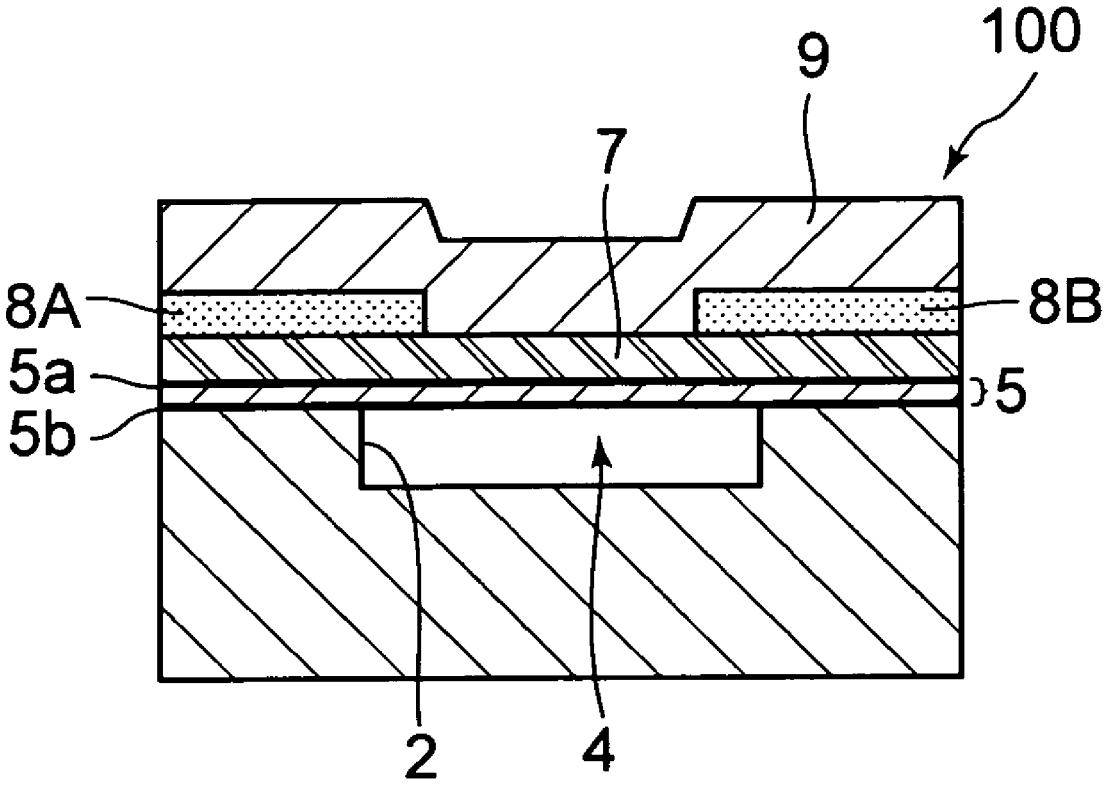
FIG. 7 PRIOR ART
FIG. 7 is a cross-sectional view of a conventional thermal head.

In the conventional thermal head 100 manufactured by the above-mentioned manufacturing method, as illustrated in FIG. 7, the lower end surface (back surface) of the upper substrate 5, that is, the surface thereof opposed to the cavity portion 4 formed in the upper end surface (surface) of the supporting substrate 3 has become the polished surface 5*d* subjected to the mechanical polishing in the pretreatment step. In the polished surface 5*d* of the upper substrate 5, there are included many microcracks caused by the mechanical polishing in the pretreatment step.

Here, with reference to FIG. 9A and FIG. 9B, a description is made of a behavior of the upper substrate 5 in a case where load is applied to the thermal head in which the cavity portion is formed.

As illustrated in FIG. 9B, when load is applied to a portion of the upper substrate 5, which is opposed to the cavity portion 4, the above-mentioned portion is deformed so as to sink down into the cavity portion 4. In this manner, as illustrated by the arrow 50 of FIG. 9B, large tensile stress occurs on the lower end surface (back surface) of the upper substrate 5, and particularly, at a center position of a region thereof to which load is applied. The tensile stress is proportional to a deformation amount of the upper substrate 5. Accordingly, in the case where load is the same, as the thickness of the upper substrate 5 decreases, the stress becomes larger. Hence, the upper substrate 5 processed to the thickness equal to or less than several ten micrometers in order to obtain high thermal efficiency has a problem in that the upper substrate 5 is prone to break from, as a starting point, the center position of the region to which load is applied, that is, the portion to which the tensile stress is applied.

In this case, in accordance with the conventional thermal head 100, many microcracks caused by the mechanical polishing included in the lower end surface (back surface) of the upper substrate 5. Accordingly, the conventional thermal head 100 has a problem in that the upper substrate 5 is prone to break when the cracks grow in the case where load is applied thereto in the plate thinning step of the upper substrate 5 and the subsequent steps. Further, also at the time of incorporating the conventional thermal head 100 into the printer, the thermal head 100 has a problem in that the upper substrate 5 is prone to break owing to pressing force by a pressure mechanism. Meanwhile, in order to prevent the upper substrate 5 from breaking, it is necessary to ensure strength of the upper substrate 5, and for this purpose, the upper substrate 5 must be thickened. As a result, the conventional thermal head 100 has a disadvantage of decreasing the thermal efficiency thereof because an amount of heat transfer from the heating resistors 7 is increased.

In contrast, in the thermal head 1 according to this embodiment, the centerline average roughness of the smooth surface 5*b* formed on the lower end surface (back surface) of the upper substrate 5 is set to be less than 5 nm, and accordingly, even in the case where load is applied to the thermal head 1 in the plate thinning step or at the time of incorporating the thermal head 1 into the printer, the growth of the cracks in the lower end surface (back surface) of the upper substrate 5, which is caused by stress concentration to the cracks, can be prevented. That is, in accordance with the thermal head 1 according to this embodiment, the strength of the upper substrate 5 is enhanced, whereby the upper substrate 5 can be thinned. Accordingly, the thermal efficiency of the thermal head 1 can be improved, and an amount of energy required for the printing can be reduced.

Further, the lower end surface (back surface) of the upper substrate 5 is subjected to the wet etching by the HF solution or HF mixed solution, whereby cut marks formed in the polishing step can be made small, and a depth of the cracks can be decreased. Thus, the growth of the cracks in the lower end surface (back surface) of the upper substrate 5 can be suppressed, and the strength of the upper substrate 5 can be enhanced.

Here, as the cracks become deeper, the stress occurring at tip ends of the cracks become larger. Then, the cracks grow. Accordingly, in at least the region of the lower end surface (back surface) of the upper substrates, which is opposed to the concave portion 2, that is, in a region to which the tensile stress is applied, an average depth of cut marks owing to the mechanical polishing or the like is set to be less than 0.1 μm, whereby the growth of the cracks can be suppressed, and the strength of the upper substrate 5 can be further enhanced.

Further, the lower end surface (back surface) of the upper substrate 5 is removed by 5 μm or more by the wet etching, whereby microcracks on the lower end surface (back surface)

of the upper substrate 5 can be removed, and the strength of the upper substrate 5 can be further enhanced.

Further, in accordance with the thermal printer 10 according to this embodiment, the above-mentioned thermal head 1 is provided, and accordingly, the thermal efficiency of the thermal head 1 can be improved in such a manner that the upper substrate 5 is thinned while ensuring the strength of the upper substrate 5, and the amount of energy required for the printing can be reduced. Thus, the printing can be performed for the thermal paper with less electric power, a battery duration can be increased, and in addition, reliability of the entire printer can be enhanced.

Note that, in the above-mentioned manufacturing process of the thermal head 1, with regard to the cracks of the upper substrate 5 owing to the heat treatment, dangling bonds of Si on the surfaces of the cracks are sometimes recombined with one another to restore an original crack-free state. This phenomenon is referred to as a crack healing effect. With regard to the crack healing effect, OH groups are terminated on the surfaces of the cracks in a state where moisture is high. In the case of performing the heat treatment in this state, the moisture is entrapped in the cavity portion 4, the dangling bonds of Si on the surfaces of the cracks remain combined with the OH groups, and it becomes difficult to restore the original crack-free state.

Hence, the supporting substrate 3 and the upper substrate 5 are bonded to each other in the dry state, and thereafter, the substrates thus bonded to each other are dried and then subjected to the heat treatment. In this manner, owing to the crack healing effect, even if the heat treatment is performed at a relatively low temperature, the cracks in the region of the upper substrate 5, which is opposed to the cavity portion 4, can be reduced, the depth thereof can also be decreased, and the strength of the upper substrate 5 can be enhanced. Specifically, the heat treatment is performed at 200° C. or higher, whereby the OH groups remaining on the surfaces of the cracks are removed, and the recombination of the dangling bonds of Si can be strengthened. Further, the heat treatment is performed at the softening point or lower, whereby the deformation of the upper substrate 5 can be suppressed, and the strength of the upper substrate 5 can be enhanced without deteriorating flatness thereof.

Second Embodiment

A thermal head 20 according to a second embodiment of the present invention is described below. Note that, in the following, a description of portions common to those of the thermal head 1 according to the above-mentioned embodiment is omitted, and portions different therefrom are mainly described.

As illustrated in FIG. 5A to FIG. 5G, a manufacturing method for the thermal head 20 according to this embodiment includes: a smooth substrate manufacturing step of manufacturing an upper substrate 5 smoothed by a fusion method, a down draw method, or the like; a cavity portion forming step of forming a concave portion 2 in a supporting substrate 3; a bonding step of bonding a surface of the supporting substrate 3 and a back surface of the upper substrate 5 to each other; a plate thinning step of thinning the upper substrate 5 bonded to the supporting substrate 3; a resistor forming step of forming heating resistors 7 on the surface of the upper substrate 5; an electrode forming step of forming electrode portions 8 on the heating resistors 7; and a protective film forming step of forming a protective film 9 on the electrode portions 8.

Here, for manufacturing general glass, a float method is used, in which plate glass is manufactured through floating fused glass in a tin bath. In order to apply such float glass thus manufactured to an electronic device, it is necessary to remove a face (tin face) of the float glass, which has been brought into contact with tin. Further, with regard to the float glass, it is difficult to achieve a plate thickness of 1 mm or less by only manufacturing the plate glass. Accordingly, a process using the mechanical polishing is essential in order to obtain material plate glass having a uniform thickness allowing relatively easy handling thereof.

In contrast, in the thermal head 20 according to this embodiment, for the upper substrate 5, such a raw glass plate manufactured by the fusion method, the down draw method, or the like is used. Further, a lower end surface (back surface) of the upper substrate 5, that is, a fire finished surface 5*f* thereof remained unprocessed after the upper substrate 5 is manufactured is bonded to an upper end surface (surface) of the supporting substrate 3.

In accordance with the fusion method or the down draw method, glass having an upper end surface (surface) with sufficiently small roughness in an unpolished state can be manufactured. Hence, in accordance with the thermal head according to this embodiment, the glass manufactured by such a manufacturing method is used as the upper substrate 5, whereby sufficient strength can be ensured even if the fire finished surface 5*f* remained unprocessed after the upper substrate 5 is manufactured is used as a bonding surface to the supporting substrate 3, and a necessity to perform flattening treatment to the lower end surface (back surface) of the upper substrate 5 by the wet etching, the mechanical polishing, or the like can be eliminated.

Third Embodiment

A thermal head 30 according to a third embodiment of the present invention is described below. Note that, in the following, a description of portions common to those of the thermal head 1 or 20 according to the above-mentioned embodiment is omitted, and portions different therefrom are mainly described.

As illustrated in FIG. 6A to FIG. 6H, a manufacturing method for the thermal head 30 according to this embodiment includes: a smooth substrate manufacturing step of manufacturing an upper substrate 5 smoothed by a fusion method, a down draw method, or the like; parallelization processing step of performing mechanical polishing to an upper substrate 5 so that the upper substrate 5 has a surface and a back surface, which are parallel to each other; a cavity portion forming step of forming a concave portion 2 in a supporting substrate 3; a bonding step of bonding a surface of the supporting substrate 3 and a back surface of the upper substrate 5 to each other; a plate thinning step of thinning the upper substrate 5 bonded to the supporting substrate 3; a resistor forming step of forming heating resistors 7 on the surface of the upper substrate 5; an electrode forming step of forming electrode portions 8 on the heating resistors 7; and a protective film forming step of forming a protective film 9 on the electrode portions 8.

In accordance with the thermal head 30 according to this embodiment, glass manufactured by the fusion method, the down draw method, or the like is used as the upper substrate 5, and the mechanical polishing is performed to an upper end surface (surface) of the upper substrate 5, whereby the upper substrate 5 having a high parallelism can be formed. Thus, the upper substrate 5 reduced in thickness variations can be formed, and accordingly, thermal efficiency of all the thermal heads 1 arranged on the entire substrate can be uniformed, and yield of the thermal heads 1 can be enhanced.

Hereinabove, the respective embodiments of the present invention are described in detail with reference to the drawings. However, specific structures of the present invention are not limited to these embodiments, and include design modifications and the like without departing from the gist of the present invention.

For example, in the first embodiment, the smoothing treatment for the upper substrate 5 in the smoothing step does not need to be performed to the entire of the lower end surface (back surface) of the upper substrate 5, and the smoothing treatment may be performed to only the region of the lower end surface, which is opposed to the concave portion 2.

Further, though a configuration is adopted, in which the rectangular concave portion 2 extending in the longitudinal direction of the supporting substrate 3 is formed, and the cavity portion 4 has the communication structure opposed to all of the heating resistors 7, another configuration to be described below may be adopted in place of this configuration. Specifically, concave portions independent of one another may be formed in the longitudinal direction of the supporting substrate 3 at positions opposed to the respective heater portions 7A of the heating resistors 7, and cavity portions independent for each concave portion may be formed through closing the respective concave portions by the upper substrate 5. In this manner, a thermal head including a plurality of hollow heat-insulating layers independent of one another can be formed.

What is claimed is:

1. A thermal head, comprising:

a supporting substrate including a concave portion in a surface thereof;

an upper substrate bonded in a stacked state to the surface of the supporting substrate; and a heating resistor provided at a position, which corresponds to the concave portion, of a surface of the upper substrate, wherein a centerline average roughness of at least a region of a back surface of the upper substrate is set to be less than 5 nm, the region being opposed to the concave portion.

2. A thermal head according to claim 1, wherein an average depth of a mark formed in at least the region of the back surface of the upper substrate is set to be less than 0.1 μm, the region being opposed to the concave portion.

3. A thermal head according to claim 1, wherein wet etching by HF solution is performed to at least the region of the back surface of the upper substrate, the region being opposed to the concave portion.

4. A thermal head according to claim 1, wherein a surface layer in at least the region of the back surface of the upper substrate is removed by anisotropic etching, the region being opposed to the concave portion.

5. A thermal head according to claim 3, wherein at least the region of the back surface of the upper substrate is removed by wet etching by 5 μm or more, the region being opposed to the concave portion.

6. A thermal head according to claim 4, wherein at least the region of the back surface of the upper substrate is removed by wet etching by 5 μm or more, the region being opposed to the concave portion.

7. A thermal head according to claim 1, wherein the upper substrate is a raw glass plate manufactured by one of a fusion method and a down draw method, and wherein the back surface of the upper substrate bonded to the surface of the supporting substrate is a fire finished surface remained unprocessed after the upper substrate is manufactured.

8. A thermal head according to claim 7, wherein mechanical polishing is performed to the surface of the upper substrate to enhance parallelism of the upper substrate.

9. A thermal head according to claim 1, wherein the supporting substrate and the upper substrate are bonded to each other in a dry state, and wherein the substrates bonded to each other are subjected to heat treatment at 200° C. or higher and softening points of the substrates or lower.

10. A printer comprising the thermal head according to claim 1.

* * * * *